United States Patent [19]

Grass

[11] Patent Number: 4,870,716

[45] Date of Patent: Oct. 3, 1989

[54] COVERING ELEMENT FOR FURNITURE HINGES

[75] Inventor: Alfred Grass, Höchst, Austria

[73] Assignee: Alfred Grass Ges.m.b.H. Metallwarenfabrik, Hochst/Vlbg., Austria

[21] Appl. No.: 128,935

[22] Filed: Dec. 4, 1987

[30] Foreign Application Priority Data

Jul. 24, 1987 [DE] Fed. Rep. of Germany ... 8710126[U]

[51] Int. Cl.[4] ..... E05D 11/00

[52] U.S. Cl. ..... 16/251; 16/250

[58] Field of Search ..... 16/250, 251, 238

[56] References Cited

U.S. PATENT DOCUMENTS 4,359,802 11/1982 Rock ..... 16/238

FOREIGN PATENT DOCUMENTS 2658831 6/1978 Fed. Rep. of Germany ..... 16/251

1464018 12/1966 France ..... 16/251

381732 10/1932 United Kingdom ..... 16/251

447650 5/1936 United Kingdom ..... 16/251

8707672 12/1987 World Int. Prop. O. ..... 16/250

*Primary Examiner*—Richard K. Seidel

*Assistant Examiner*—Carmine Cuda

[57] ABSTRACT

A covering element for a furniture hinge has a central channel portion which is substantially U-shaped in cross-section. The sides of the U-shaped section are extended at one end beyond the base of the U and the extensions have aligned holes formed in them to receive a pin for pivotal connection to a hinge member. The cover encloses parts of the hinge used for adjusting the relative angular and spatial positions of the hinge members, to prevent accidental displacement. In the closed position of the covering element, inwardly turned extensions of the channel edges form a snap fit around a hinge casing, and the end of the hinge is enclosed by an angled-over extension of the channel base.

3 Claims, 2 Drawing Sheets

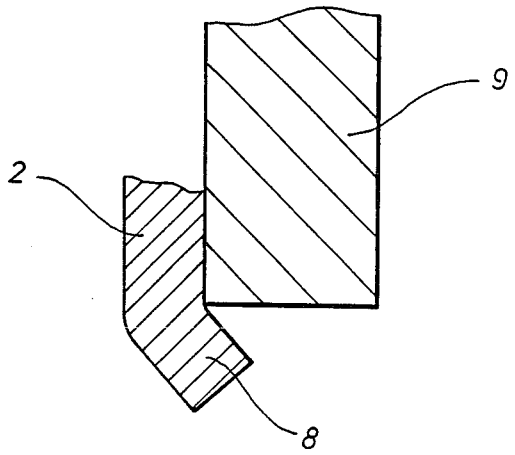
FIG 4 (IV-IV)

COVERING ELEMENT FOR FURNITURE HINGES

BACKGROUND OF THE INVENTION

The invention relates to a covering element for furniture hinges.

The invention has the fundamental object of providing a covering element of this nature, which allows the position of the parts of the furniture hinge to be adjusted, all directions relative to one another. All operating elements of the covered hinge member as well as of a catch or similar plate which may be incorporated in the actual furniture hinge are protected by the covering element against an accidental operation.

SUMMARY OF THE INVENTION

The above object is achieved in accordance with the invention in that the covering element has a central part of substantially U-shaped channel section, the sides of the U-section being extended towards one end of the element beyond the base of the U and holes being formed in these extensions of the sides for the passage of a pin for connection to a hinge to form an articulation. The articulation allows the pivotable displacement of the covering element relative to the hinge, the free edges of the sides of the U being extended in a predetermined region and the extensions being bent inwards to form a detent connection to a hinge member. The end of the covering element remote from the holes has an extension angled transversely to the longitudinal direction of the element with excisions being formed in the free edges of the sides of the U adjacent said extension.

The shape and configuration of the covering element of the invention enable it to be pivotally displaced with respect to an actual furniture hinge or hinge member by means of the articulation thus formed, as will be described in particular in the following detailed description. The base of the U-shaped channel does not form an obstruction when the covering cap is pivoted because the sides of the U-shaped section extend longitudinally beyond the base in the region of the articulation. Th excisions formed at the other end of the covering element cover the components of a furniture hinge or hinge member when the covering element is in its operative position, so that all the operating elements of the furniture hinge are protected against an accidental operation when the covering element is folded down. A detent connection with a cover bracket of the furniture hinge is formed by the inwardly bent extensions of the sides of the U-shaped channel section.

The covering element of the invention may be produced wholly of metal with an attractive design. It can be secured to the hinge pin in a loss-proof manner. Lettering may be applied thereon or embossed therein. It may easily be installed and dismantled and all irregularities of the actual hinge member are masked by the covering element which provides protection against injuries and catching.

The covering cap is particularly adapted for pivotal displacement if the holes are produced as slots.

BRIEF DESCRIPTION OF THE DRAWINGS

Further objects and advantages of the invention will become apparent from the following detailed description taken in conjunction with the accompanying drawings which illustrate a preferred embodiment of the invention.

In the drawings:

FIG. 4 illustrates a section along the line IV—IV of FIG. 1.

DETAILED DESCRIPTION OF THE PREFERRED EMBODIMENT

Figure 1:
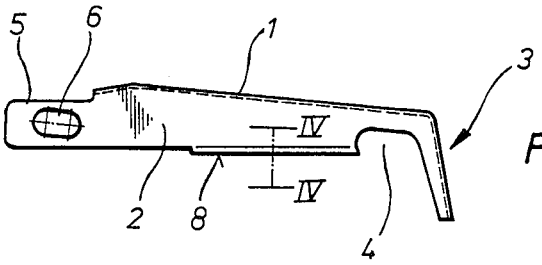
FIG. 1 illustrates a lateral view of a covering element according to the invention.

The covering element shown in FIGS. 1 and 4 is made wholly of metal, and comprises a central channel portion of substantially U-shaped cross-section, with a base 1 and sides 2. As can be seen in the FIG. 1, the covering element has at one end an L-shaped extension 3 at a preset angle across and beyond the end of the channel section. The base 1 and the sides 2 also extend as far as the extension 3. The sides 2 are however provided with excisions to form openings 4 in the area of transition toward the extension 3.

At the other end of the element the sides 2 have longitudinal extensions 5 beyond the end of the base 1 of the channel. Slots 6 aligned with each other are formed in the extensions, which are substantially parallel to one another. As is shown in FIGS. 2 and 3 a pin 7 is inserted through the slots 6 to form an articulated connection to a hinge member whereby the covering element can be displaced pivotally on the furniture hinge.

Figure 2:
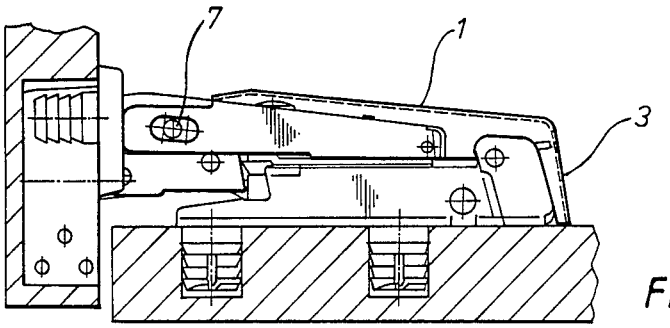
FIG. 2 illustrates the covering element in its operative state, in which it covers the hinge, two hinge members being set at right angles to each other.
Figure 3:
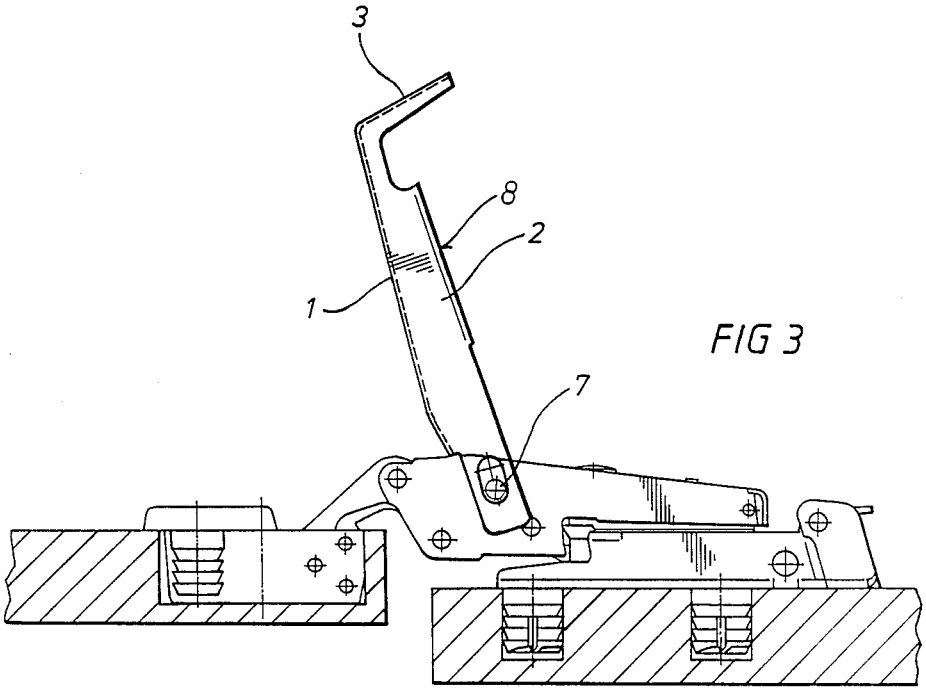
FIG. 3 illustrates the assembly of FIG. 2, but with the hinge opened and the covering element pivoted away from the hinge

The hinge assembly shown in FIGS. 2 and 3 is used to mount a door onto a panel, for example a side wall of a kitchen unit. The hinge comprises a first hinge member fixedly secured to the panel by fastening studs of nylon or the like which are retained by a friction fit in bores of the panel. Similarly a second hinge member is retained in a recess in the door by one or more studs.

The second hinge member is pivotally attached to an intermediate hinge member which is in turn attached to the first hinge member. The position and angular orientation of the intermediate member, and hence of the second hinge member relative to the first hinge member, is adjustable in three dimensions by conventional means such as screws, to enable the door to be hung straight and flat.

The covering element is secured by the pin 7 to the intermediate hinge member. As can be seen in FIG. 4, the two sides 2 of the channel section have inwardly bent extensions 8 situated along the central parts of their free edges, whereby a form-locked snap-fitting engagement of the covering element with a protective cover 9 of the intermediate hinge member is obtained. The covering element thus remains in position whether the door is open or shut and protects the various adjusting mechanisms from being accidentally dislodged from their preset positions. The open position of the covering element shown in FIG. 3 allows access to the adjusting mechanisms.

What is claimed is:

1. A covering element for a furniture hinge comprising; a channel portion having a substantially U-shaped cross section formed by a base and two sides; longitudinal extensions of said sides beyond one end of said base, each of said extensions having a hole formed therein; a pin associated with the furniture hinge and extending through said holes; an extension of said base at its other end remote from said side extensions, said base extension being angled to substantially close the end of said channel; excisions formed in said channel sides adjacent said base extension; and turned edge extensions along the edges of each of said channel sides between said longitudinal extensions and said excisions whereby the covering element pivotally opens to expose the hinge for adjustment and closes to form a snap fit and protects the hinge from damage and accidental displacement.

2. A covering element as claimed in claim 1 wherein the holes are formed as elongate slots.

3. A covering element as claimed in claim 1 wherein said edge extensions are turned inwardly toward each other.

* * * * *